US011071358B2

(12) United States Patent
Aviv et al.

(10) Patent No.: US 11,071,358 B2
(45) Date of Patent: Jul. 27, 2021

(54) INTERCHANGEABLE JEWELRY LINKING SYSTEM AND CLASPS THEREOF

(71) Applicants: David Aviv, Tel Aviv (IL); Helen Dukat, Tel Aviv (IL); Mango Tree Jewelry LTD, Tel Aviv (IL)

(72) Inventors: David Aviv, Tel Aviv (IL); Helen Dukat, Tel Aviv (IL)

(73) Assignee: Mango Tree Jewelry LTD., Tel Aviv (IL)

( * ) Notice: Subject to any disclaimer, the term of this patent is extended or adjusted under 35 U.S.C. 154(b) by 0 days.

(21) Appl. No.: 15/754,358

(22) PCT Filed: Aug. 24, 2017

(86) PCT No.: PCT/IL2017/050946
§ 371 (c)(1),
(2) Date: Feb. 22, 2018

(87) PCT Pub. No.: WO2018/042419
PCT Pub. Date: Mar. 8, 2018

(65) Prior Publication Data

US 2019/0045888 A1 Feb. 14, 2019

(30) Foreign Application Priority Data

Aug. 28, 2016 (IL) ..... 247521

(51) Int. Cl.
*A44C 15/00* (2006.01)
*A44C 5/20* (2006.01)
(Continued)

(52) U.S. Cl.
CPC ..... *A44C 5/2023* (2013.01); *A44B 19/12* (2013.01); *A44B 19/26* (2013.01); *A44C 5/18* (2013.01);
(Continued)

(58) Field of Classification Search
CPC ..... A44C 5/2023; A44C 13/00
See application file for complete search history.

(56) References Cited

U.S. PATENT DOCUMENTS 266,007 A * 10/1882 Badger ..... A24F 13/26 131/250
415,770 A * 11/1889 Ferguson ..... A41F 11/02 24/537

(Continued)

FOREIGN PATENT DOCUMENTS

EP 0 046 123 2/1982
EP 0 052 583 5/1982

(Continued)

OTHER PUBLICATIONS

International Application PCT/IL2017/050946 as Filed on Aug. 24, 2017.

(Continued)

*Primary Examiner* — Jason W San
(74) *Attorney, Agent, or Firm* — The Law Office of Joseph L. Felber

(57) ABSTRACT

A clasp for a jewelry system has two arms and a sleeve that can slide to a position covering at least portions of both arms. In this position, the sleeve urges the clasp from an un-locked state towards a locked state.

5 Claims, 15 Drawing Sheets

(51) Int. Cl.

| | |
|---|---|
| ***A44C 13/00*** | (2006.01) |
| ***A44C 5/22*** | (2006.01) |
| ***A44B 19/12*** | (2006.01) |
| ***A44B 19/26*** | (2006.01) |
| ***A44C 5/18*** | (2006.01) |

(52) U.S. Cl.
CPC ..... *A44C 5/20* (2013.01); *A44C 5/2004* (2013.01); *A44C 5/22* (2013.01); *A44C 13/00* (2013.01)

(56) References Cited

U.S. PATENT DOCUMENTS 700,208 A * 5/1902 Lafo ..... D06F 55/00 24/551
1,127,676 A * 2/1915 Ramm ..... A41F 11/04 24/346
3,760,468 A * 9/1973 Linville ..... A01K 83/00 24/601.8
4,061,910 A * 12/1977 Rosenfeld ..... A44C 15/0015 362/34
4,095,315 A * 6/1978 McGahee ..... A01K 85/16 24/601.7
4,112,608 A * 9/1978 McGahee ..... A01K 85/16 43/42.09
4,447,250 A * 5/1984 Wolens et al. ..... A63H 37/00 2/209.13
4,562,704 A * 1/1986 Benedek ..... A44C 5/2047 24/616
4,763,489 A 8/1988 Strong
4,958,420 A 9/1990 Bunz
6,088,884 A 7/2000 Hentz
6,196,921 B1 * 3/2001 Larson ..... F41B 15/02 463/47.2
6,243,929 B1 6/2001 Curwood
6,681,598 B2 * 1/2004 Cheng ..... A44C 11/002 24/574.1
6,691,450 B2 * 2/2004 Glavinich ..... A01K 91/04 43/4.5
6,898,894 B1 * 5/2005 Anderson ..... A01K 85/00 43/42.39
D590,530 S * 4/2009 Tsai ..... D26/51
D602,680 S * 10/2009 Lopez ..... D2/891
D670,188 S * 11/2012 Fissell ..... D11/3
9,332,812 B2 * 5/2016 Ma ..... A44C 15/0015
9,488,325 B2 * 11/2016 Dai ..... F21L 4/02
9,538,735 B1 * 1/2017 Rider ..... A01K 83/00
10,136,626 B1 * 11/2018 Rider ..... A44C 15/005
10,531,714 B2 * 1/2020 Okamura ..... A44C 25/00
2003/0026089 A1 * 2/2003 Hsu ..... G08B 5/004 362/103
2003/0182844 A1 * 10/2003 Berthold ..... A01K 83/00 43/44.83
2004/0100790 A1 * 5/2004 Bryant ..... A44C 15/0015 362/34
2005/0116471 A1 * 6/2005 Muir ..... A01K 91/04 289/17
2005/0213343 A1 * 9/2005 Jablonski ..... A44C 5/0053 362/602
2006/0181886 A1 * 8/2006 LaCrosse ..... F21S 10/002 362/385
2006/0262531 A1 * 11/2006 Schrimmer ..... A44C 15/005 362/240
2007/0081324 A1 * 4/2007 Schrimmer ..... G02C 11/04 362/103
2008/0041098 A1 2/2008 Lafauci et al.
2008/0256979 A1 * 10/2008 Okamura ..... A44C 5/2071 63/3.1
2012/0085298 A1 * 4/2012 Wolters ..... A01K 27/006 119/859
2012/0174350 A1 * 7/2012 Delle Donne ..... A01K 91/04 24/457
2016/0113359 A1 4/2016 Lafond
2016/0166018 A1 * 6/2016 Morinville ..... A44C 5/209 63/3.1

FOREIGN PATENT DOCUMENTS

GB 127447 6/1919
GB 2 175 192 11/1986

OTHER PUBLICATIONS

International Search Report and Written Opinion of International Application PCT/IL2017/050946, dated Dec. 21, 2017.

* cited by examiner

INTERCHANGEABLE JEWELRY LINKING SYSTEM AND CLASPS THEREOF

FIELD OF THE INVENTION

Embodiments of the present invention relate generally to interchangeable jewelry linking clasps (or Interchangeable Jewelry Connector—IJC) for necklaces/bracelets/anklets/rings/earrings and any other jewelry related items. In particular, the jewelry clasps (IJC) enable jewelry components such as ornaments/charms/pendants/chains and other jewelry parts to be interchangeable (e.g. connected/disconnected) with ease, and thereby providing an interchangeable jewelry that can be easily designed and suited hence allowing the creation of many jewelry design possibilities using generally similar parts.

BACKGROUND OF THE INVENTION

Jewelry items usually come with a permanent design that cannot be modified and tailored for a specific event, mood, outfit and so on. This results in owning a wide variety of jewelry which can be costly and impractical. Those jewelries usually consist with variant kinds of known clasps such as: "Lobster claw" [FIG. 1A], "springring" [FIG. 1B], kinds of screwing clasp as illustrated in FIG. 1C and different kinds of hooks that need to be threaded as illustrated in FIGS. 1D-1F.

Some jewelries are modular and can be adjust with diverse jewelry elements and ornaments. For example, US 2008/0250616 discloses a jewelry clasp comprising means to hold multiple, easily replaceable and interchangeable jewelry items. US 2012/0174626 discloses multiple element jewelry system that can be worn in a variety of ways. However, said jewelries consist with variety of screwing and/or spring clasps that might be complex and time consuming assembly.

SUMMARY OF THE INVENTION

It is an object of at least certain embodiments of the present invention to provide, a jewelry linking system and clasps thereof that can be easily used for changing or appending pendants, ornaments, charms, chains and/or other jewelry elements to possibly create many new design possibilities while using the same parts and/or adjust jewelries with ease.

It is another object of at least certain embodiments of the present invention to provide a jewelry clasp designed to prevent from any element of the clasp to get lost as no element is disconnected from the chain, not even at the open state while replacing a pendant or ornaments.

Other objects and advantages of the invention will become apparent as the description proceeds.

The present invention in at least certain embodiments relates to a clasp for enabling a jewelry to become interchangeable, comprising: a) a pin having two arms, in which the pin is configured in such a way that the arms are adapted to be pressed together in order to reduce the distance between them as to allow said arms to be embraced together, once the pressure will be released, the distance between the arms will increase; and b) a sleeve adapted for being threaded on a chain in a way that it can move along the chain, wherein said sleeve has an internal diameter suitable to embrace the arms of said pin, as to maintain said arms in a press state, thereby enabling to close said clasp and to securely hold at least one jewelry element.

According to an embodiment of the invention, one arm of the pin is connected to one end of the chain. The chain can be part of a jewelry related item, such as a bracelet/anklet/ring/earring and so on, to which the arm can be welded or attached. For example, the arm may be permanently connected by welding.

According to an embodiment of the invention, one arm of the pin remains unconnected, so that one or more ornaments/charms/pendants/different jewelries, such as necklace/bracelet/earring can be threaded through and/or upon the unconnected arm.

In another aspect, the present invention relates to an interchangeable jewelry linking system, comprising: a) one or more clasps, wherein each clasp includes: i) a pin having two arms that are adapted to be pressed together in order to reduce the distance between them as to allow said arms to be embraced together, so that once the pressure will be released, the distance between the arms will increase; ii) a sleeve adapted for being threaded on a chain in a way that it can move along the chain, wherein each sleeve has an internal diameter suitable to embrace the arms of said pin, as to maintain said arms in a press state, thereby enabling to close said clasp and to securely hold at least one jewelry element; and b) a chain connected to one arm of each pin.

According to an embodiment of the invention, the jewelry system further comprises one or more jewelry elements or other jewelries adapted to be secured by each of the one or more clasps.

In another aspect, the present invention relates to a ring-like clasp for enabling a jewelry to become interchangeable, comprising: a) a pin having an opened ring-like form, so that one end of the pin faces the other end of the pin; and b) a sleeve slidably attached to one end of said pin, thus by sliding said sleeve towards the other end of said pin, the ring-like clasp becomes locked, and by sliding said sleeve in the opposite direction, the ring-like clasp becomes unlocked.

Further aspects of the present invention are exemplified in the following:

1. A clasp which serves as a linking mechanism for enabling a jewelry to become interchangeable, comprising:
   a. A pin having two arms, in which the pin is configured in such a way that the arms are adapted to be pressed together in order to reduce the distance between them as to allow said arms to be embraced together, once the pressure will be released, the distance between the arms will increase; and
   b. A sleeve adapted for being threaded on a chain in a way that it can move along the chain, wherein said sleeve has an internal diameter suitable to embrace the arms of said pin, as to maintain said arms in a press state, thereby enabling to close said clasp and to securely hold at least one jewelry element;

wherein the press state is maintained by a tension and/or friction force that is generated between the inner surface of the sleeve and the arms which strive to increase the interval between them to return to their release state; and wherein the clasp is released in a single-action release mechanism, in which sufficient external force is applied on the sleeve, which exceeds the threshold of said friction force in order to move the sleeve along the chain.

2. A clasp according to aspect 1, wherein one arm of the pin is connected to one end of the chain.

3. A clasp according to aspect 1, wherein the chain is part of a jewelry related item, such as a bracelet, anklet, ring, or earring to which the arm of the pin can be welded or attached.

4. A clasp according to aspect 2, wherein one arm of the pin remains unconnected, so that one or more ornaments or different jewelries can be threaded through the unconnected arm.

5. An interchangeable jewelry linking system, comprising:

a) One or more clasps serving as a linking mechanism, wherein each clasp includes: i) a pin having two arms that are adapted to be pressed together in order to reduce the distance between them as to allow said arms to be embraced together, so that once the pressure will be released, the distance between the arms will increase; ii) a sleeve adapted for being threaded on a chain in a way that it can move along the chain, wherein each sleeve has an internal diameter suitable to embrace the arms of said pin, as to maintain said arms in a press state, thereby enabling to close said clasp and to securely hold at least one jewelry element; and wherein the press state is maintained by a tension and/or friction force that is generated between the inner surface of the sleeve and the arms which strive to increase the interval between them to return to their release state; wherein the clasp is released in a single-action release mechanism, in which sufficient external force is applied on the sleeve, which exceeds the threshold of said friction force in order to move the sleeve along the chain; and b) A chain connected to one arm of each pin.

6. The jewelry system according to aspect 5, further comprising one or more jewelry elements or other jewelries adapted to be secured by each of the one or more clasps.

7. The jewelry system according to aspect 5, wherein the chain is part of a jewelry related item, such as a bracelet, anklet, ring, or earring to which the arm of the pin can be welded or attached.

DETAILED DESCRIPTION OF THE INVENTION

Reference will now be made to several embodiments of the present invention, examples of which are illustrated in the accompanying figures. Wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1A:
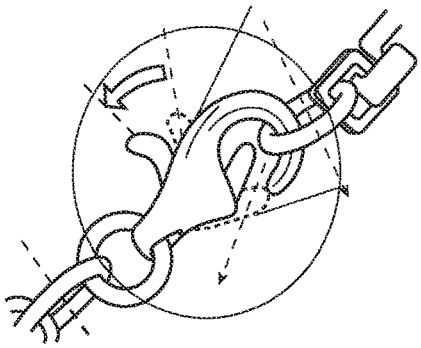
FIGS. 1A-1F schematically illustrate different types of clasp, according to the prior art.
Figure 1B:
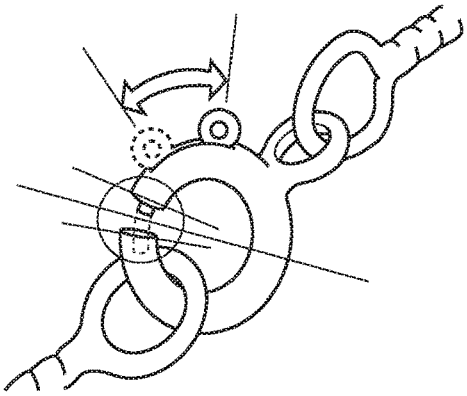
Figure 1D:
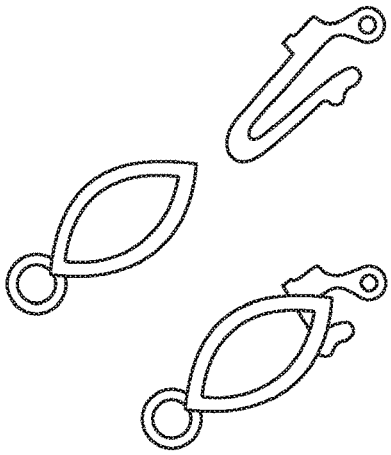
Figure 1C:
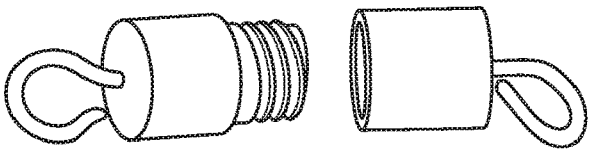
Figure 1E:
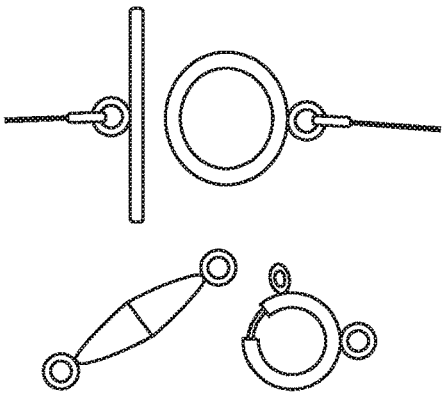
Figure 1F:
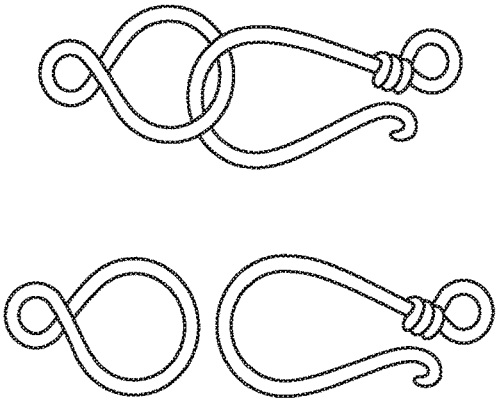
Figure 2:
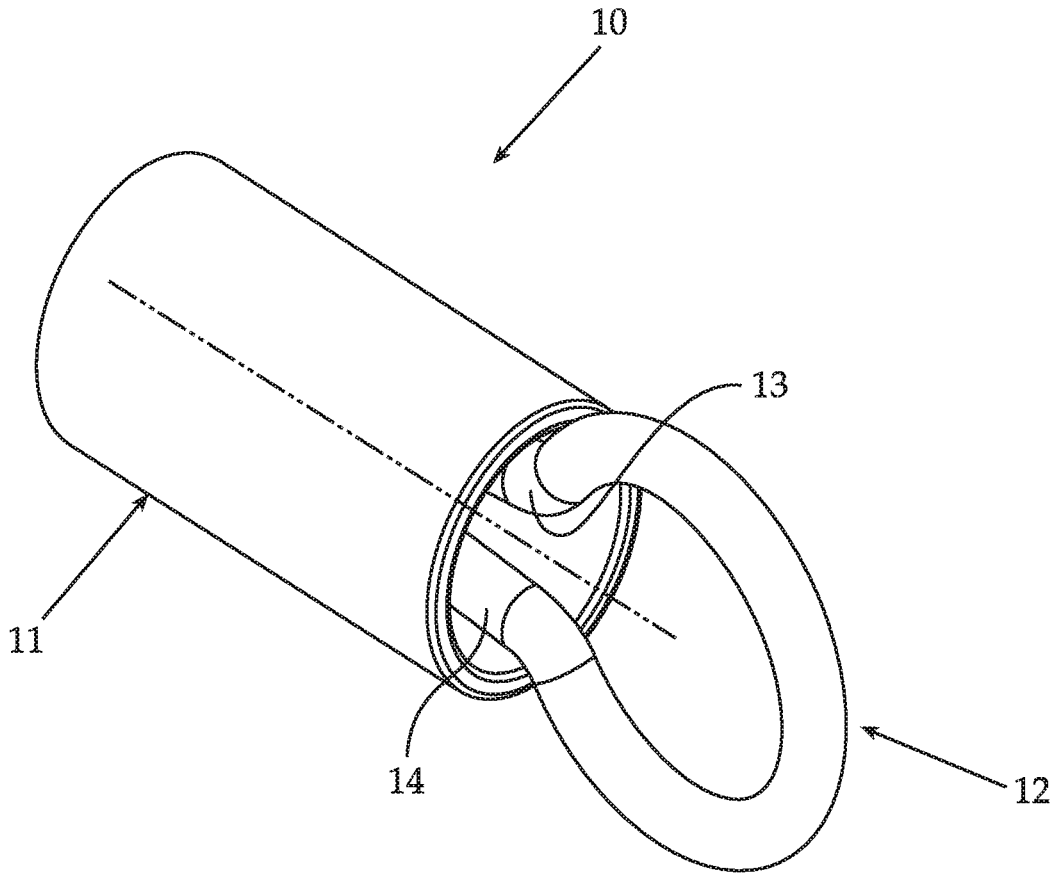
FIG. 2 schematically illustrates a clasp that includes a sleeve and a pin according to an embodiment of the present invention.

FIG. 2 schematically illustrates a clasp 10 in accordance with an embodiment of the present invention. Clasp 10 may be defined as having two primary elements, a first element being a sleeve 11 and the second element being a pin 12.

Figure 3A:
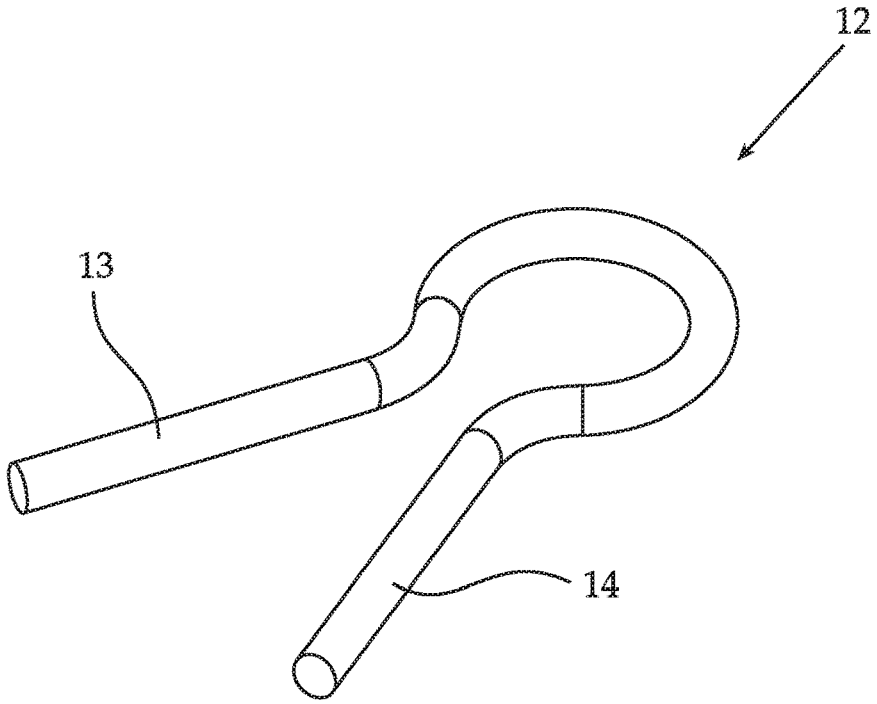
FIG. 3A schematically illustrates the pin of the clasp of FIG. 2 in a released state.
Figure 3B:
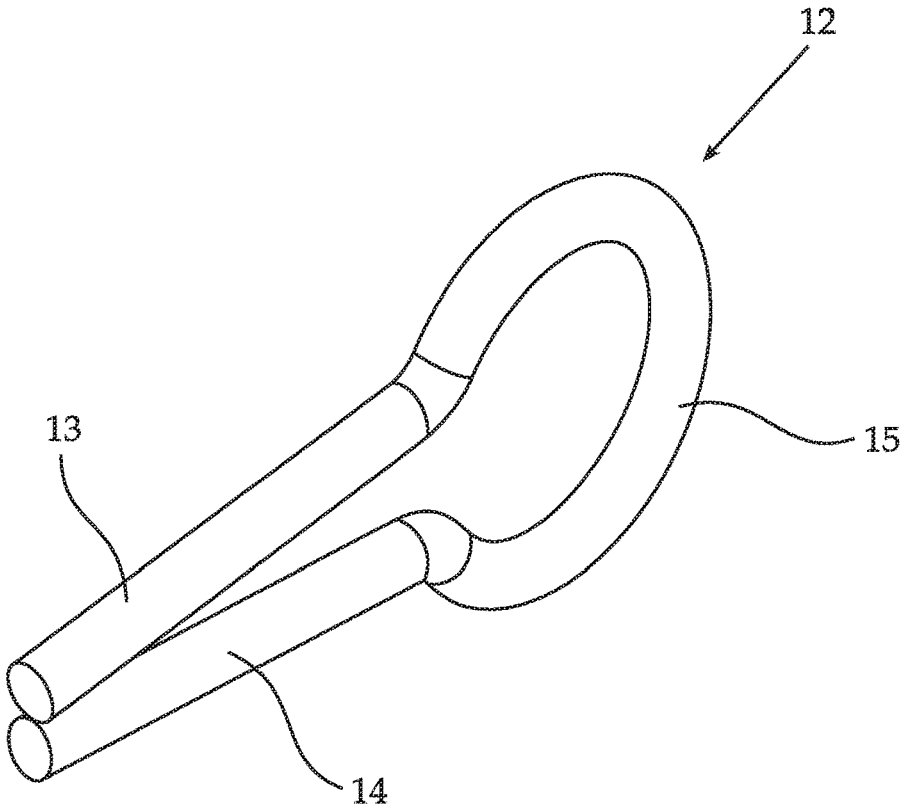
FIG. 3B schematically illustrates the pin of the clasp of FIG. 2 in a pressed state.

Pin 12, as best seen in FIGS. 3A and 3B, has two legs or arms 13 and 14, and may be configured in such a way that arms 13,14 are adapted to be pressed together in order to reduce the distance between them (as shown in FIG. 3B) as to allow said arms to be embraced together by a corresponding sleeve or an embrace hoop 11 (e.g., as shown in FIG. 2). Once the pressure will be released, the distance between arms 13, 14 will increase (as shown in FIG. 3A) due to the elastic properties of pin 12.

Figure 5A:
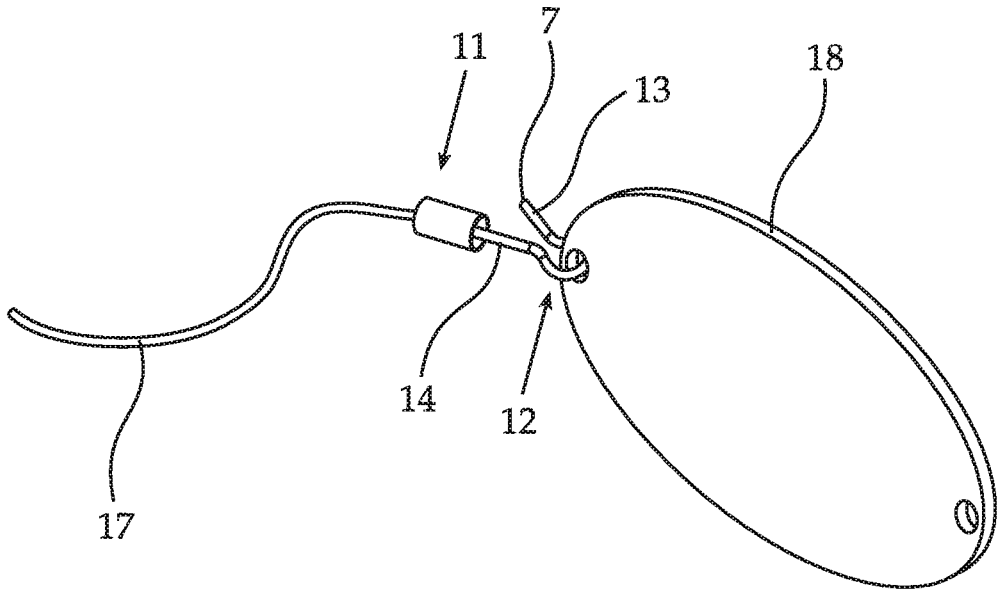
FIG. 5A schematically illustrates the clasp of FIG. 2 as part of a jewelry system in an open state.

According to an embodiment of the present invention, one arm of pin 12 (e.g., arm 14) may be permanently connected to a chain, e.g., by welding or other connecting means, while the other arm (e.g., arm 13) remains free (i.e. remains with a free un-attached end 7 that can be seen marked in FIG. 5A) so as to allow a pendant (or alternative jewelry element) to be threaded through and/or upon it, e.g., as schematically illustrated in FIG. 5A where arm 14 of pin 12 is connected to one end of a chain 17 such that a pendant 18 can be threaded through and/or upon arm 13.

Figure 8A:
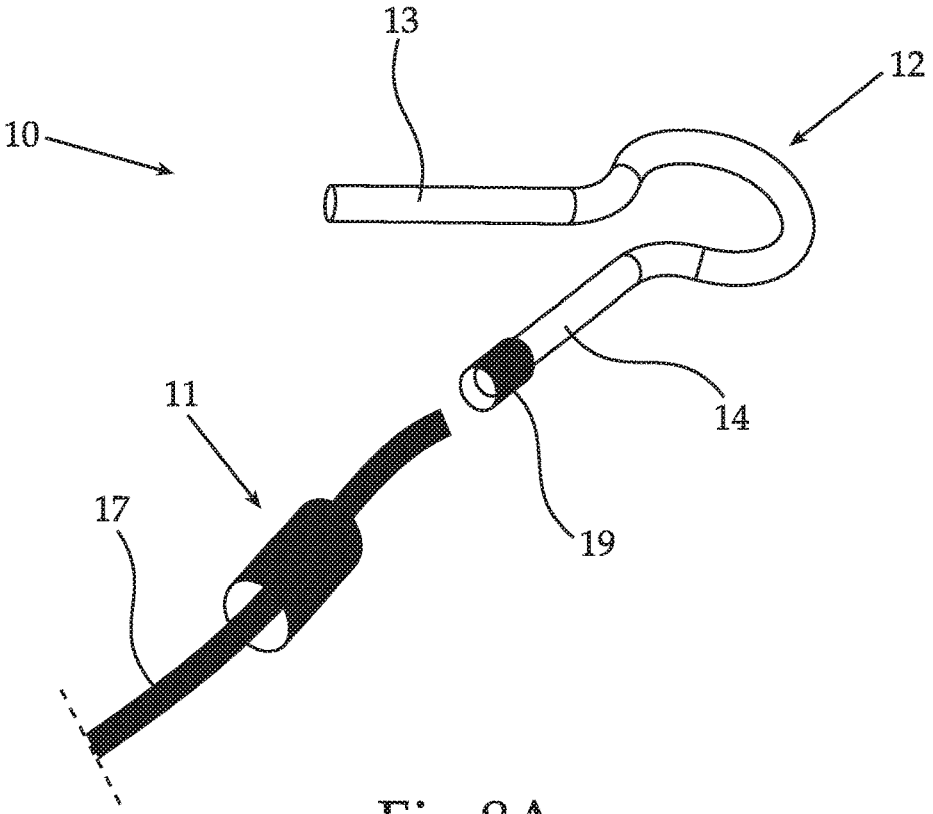
FIGS. 8A and 8B schematically illustrate a clasp, according to yet another embodiment of the present invention.
Figure 8B:
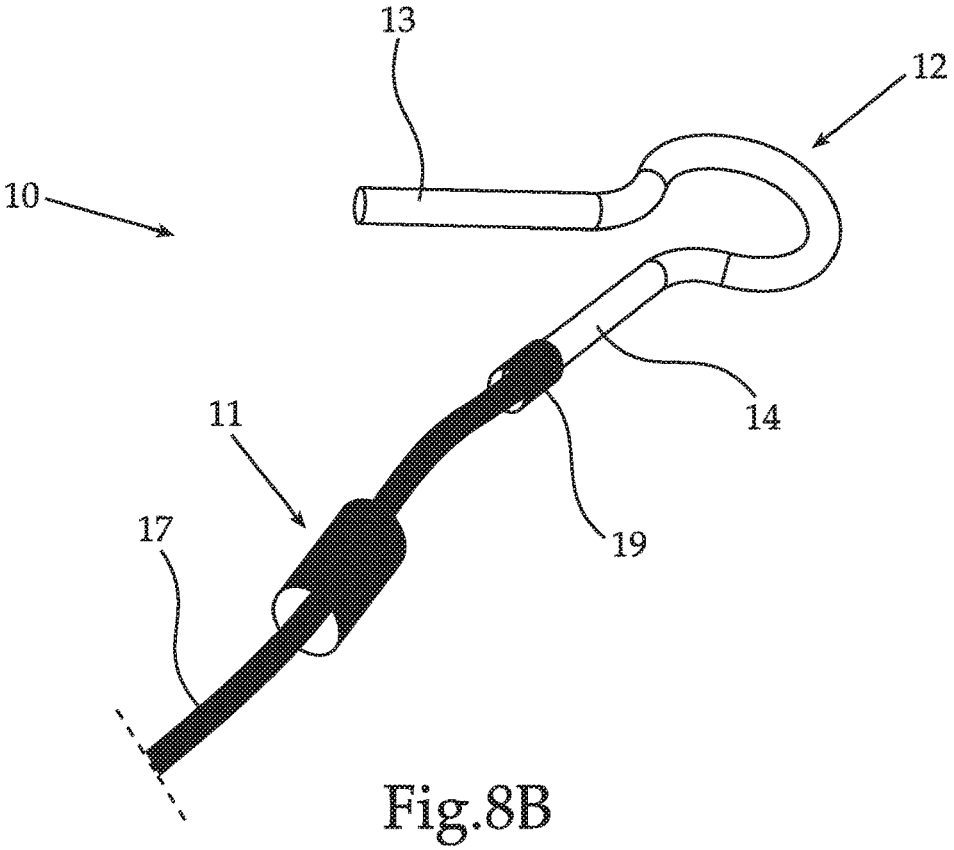

Attention is drawn to FIGS. 8A and 8B illustrating an embodiment of a clasp 10 including a pin 12 that may be configured for attachment (possibly permanent attachment) at one arm (here arm 14) to a chain 17. In this example, such attachment may be facilitated by a possible connecting member 19 here initially attached to an end of arm 14, however member 19 may equally be connected to an end of chain 17 (this option not being shown) that may then be configured for attachment to arm 14 or 13.

In FIG. 8A, chain 17 is illustrated initially un-attached to clasp 10 and in FIG. 8B an end of chain 17 is seen located within member 19 that may then be manipulated, e.g. by crimping, in order to attach arm 14 to chain 17. As illustrated, chain 17 e.g. prior to being attached clasp 10 may be threaded through sleeve 11, so that after attachment sleeve may be fitted over the two arms of the clasp.

In an aspect of the present invention, embodiments of clasp via its two-legged pin and slidable sleeve combination; may provide enhanced utility while maintaining a relative low aesthetic profile advantageous in a jewelry system.

Such enhanced utility may be embodied by pin at one of its arms (e.g. arm 14 in FIG. 5) being configured to provide attachment to a chain while this same arm also being used for assisting in maintaining sleeve in place once placed over the collapsed arms. The maintaining of the sleeve in place being facilitated by the arms (including the arm attached to the chain) being configured to also flex outwards against the sleeve's inner surface.

In another example, the arced shaped head 15 of the pin being located in between the two arms and connected to the arms, being configured to enhance on the one hand elasticity required for urging the arms away from each other while also serving as a suitable semi-loop-like structure for attachment to other jewelry members such as chains, clasps, pendants (or the like).

In yet a further example, the sleeve that is configured to conceal the two-legged (or arm) mechanism of the pin when assembled thereupon (see, e.g., FIG. 9 and their respective explanations here below); provides an aesthetic appearance to embodiments of the clasp that substantially resembles a jewelry part or member (and not necessarily a primarily functional clasp like part that normally remains visible—see FIGS. 1A to 1F).

The sleeve by virtue of being preferably devoid of any openings, apertures, slits (or the like) in its periphery, that may reveal its interior, assists in concealing its interior two-legged mechanism.

Figure 9A:
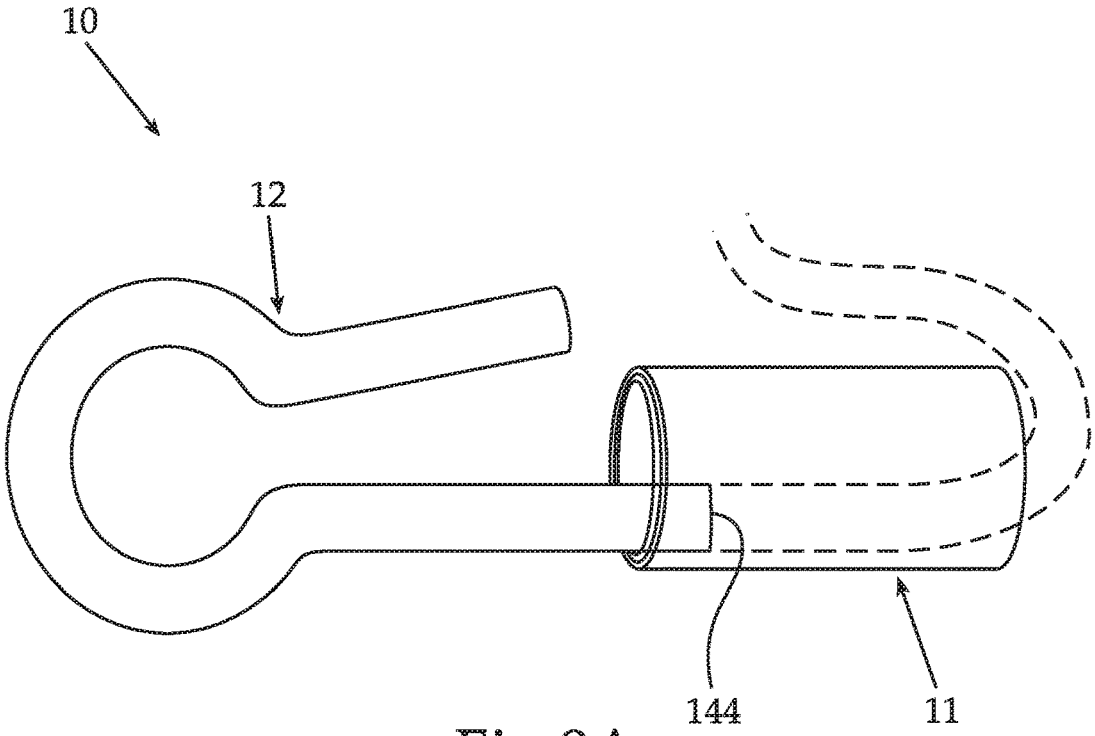
FIGS. 9A and 9B schematically illustrate a clasp, according to an embodiment of the present invention, in respective un-locked and locked states.
Figure 9B:
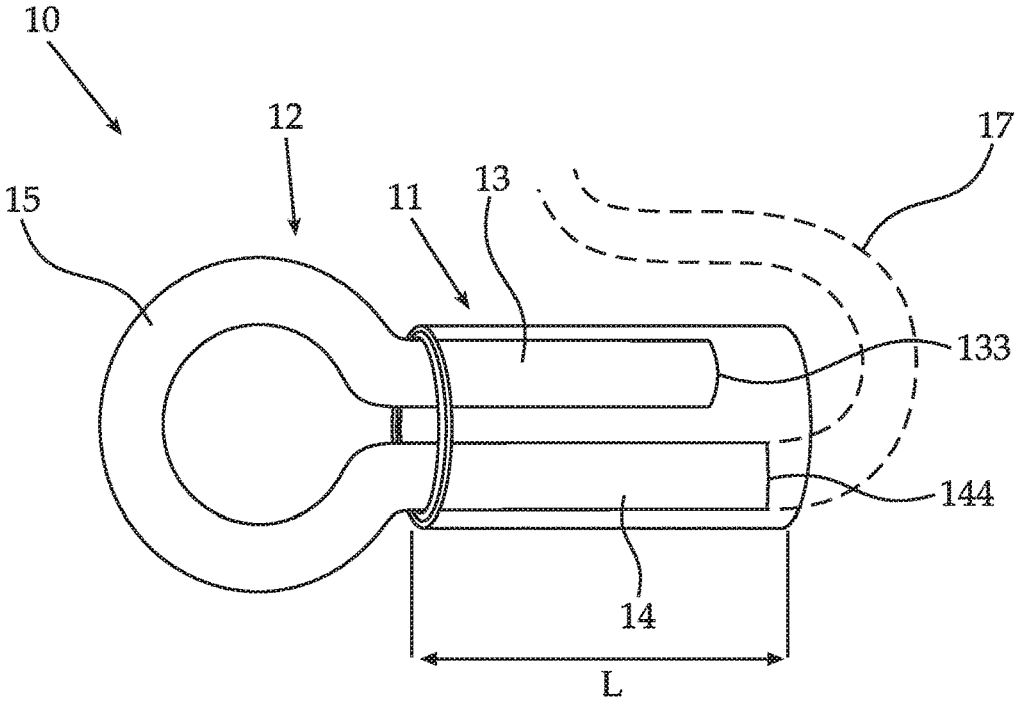

Attention is drawn to FIGS. 9A and 9B illustrating an embodiment of a clasp 10 in respective un-locked (9A) and locked (9B) states. Turning first to the locked state illustrated in FIG. 9B, a possible aspect of the present invention is embodied in at least one of the arms (legs), her arm 13, being configured to be shorter than the other arm, here 14. In the shown example, the longer arm 14 is seen being attached to a chain 17, however it is noted that chain 17 may also be attached to the shorter arm, here 13.

In some cases, connecting the chain to the longer arm reduces likelihood of the chain and other arm meeting/interfering with each other when located within the sleeve, hence possibly requiring increasing the diameter of the sleeve if chain were to be connected to the shorter arm), which may hinder the aesthetic low profile appearance of the clasp.

The different extensions of the arms being more visible and measurable in a clasp where both arms are relatively pressed towards each other, to consequently substantially extend from the arced head 15 of the clasp alongside each other, as e.g. in the locked state of the clasp where both arms are maintained relatively close to each other by sleeve 11. Arm 13 is here seen extending from head 15 to an end 133 and arm 14 is here seen extending from head 15 to and end 144 that lies beyond end 133, and hence arm 14 projects beyond end 133 of arm 13.

In an aspect of the present invention, sleeve 11 (e.g. when pressed at one of its axial ends against head 15) may be sized to have an axial extension L that is preferably sized to cover and conceal the arms in the locked state of at least certain clasp embodiments. In FIG. 9B, the axial sizing L of sleeve 11 is illustrated concealing in this clasp example two arms of different axial extensions, however such concealing of arms is also preferably provided in embodiments having arms of generally equal axial extensions.

Such concealing of the arms in the locked state of a clasp provides an aesthetic appearance to the clasp that resembles a jewelry part or member (and not necessarily a primarily functional clasp like part that normally remains visible—see FIGS. 1A to 1F)

Turning to FIG. 9A, an aspect of the present invention pertaining to a possible method of urging at least certain clasp embodiments towards a locked state will be discussed. In a possible first step of such method, the longer arm of the clasp, here arm 14, is urged (preferably manually) to a position where a portion adjacent its end 144 is located within sleeve 11.

Once in this position, sleeve 11 (manually held by a user of the clasp) may be used as a bearing base upon which the other arm, here arm 13, can be pressed against in order to urge it towards arm 14. Once both arms are maintained adjacent each other (e.g. extending generally one alongside the other), pin 12 of the clasp can easily be slipped into sleeve 11 and/or sleeve 11 can easily be moved over the arms to reach the locked state seen in FIG. 9B.

As will be appreciated by a person skilled in the art, pin 12 may have any shape or size as long as it has two arms.

Figure 4:
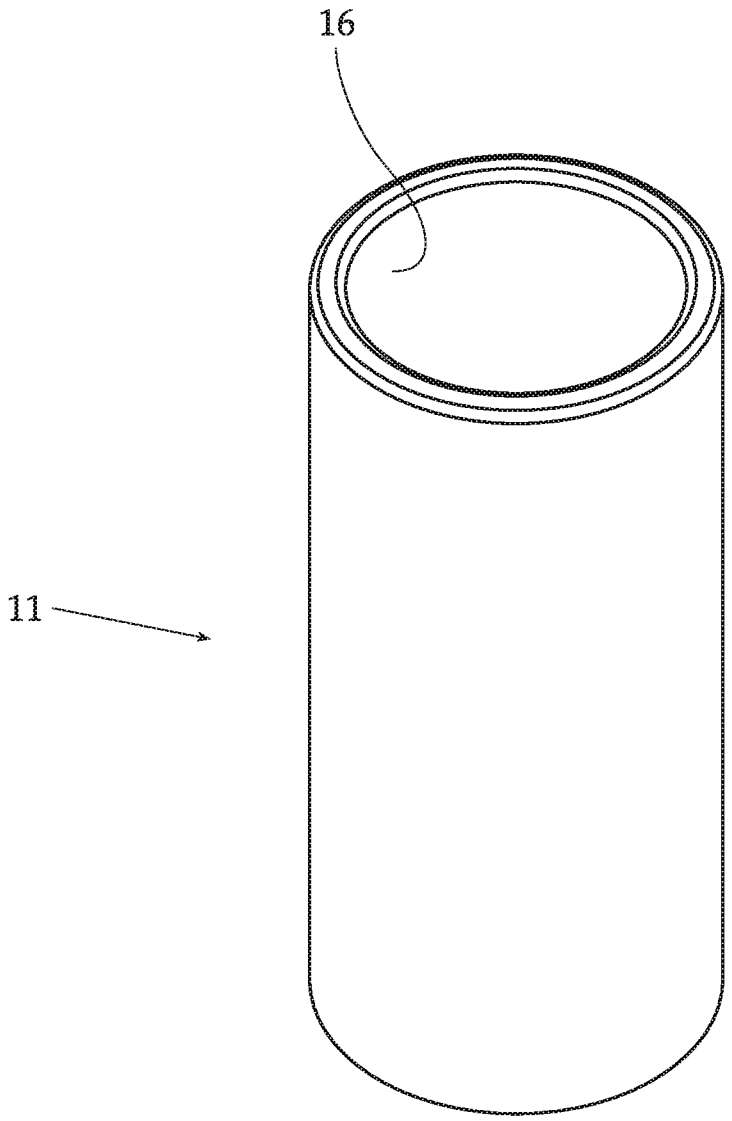
FIG. 4 schematically illustrates the sleeve of the clasp of FIG. 2.

Sleeve 11, as best seen in FIG. 4, which may be generally bead like in shape, may be adapted for being threaded on the jewelry's chain 17 (see, e.g., FIG. 5) in a way that it can slidably move along the chain 17, possibly in a free manner. Moreover, sleeve 11 has an internal diameter suitable to embrace arms 13, 14 of pin 12, so as to maintain them in a pressed state due to the generation of tension and force between the arms 13, 14 and the internal surface 16 of sleeve 11.

For engaging clasp 10, one may press arms 13, 14 of pin 12 towards each other and then just thread sleeve 11 on arms 13, 14. Arms 13, 14 will create a force with sleeve 11 as they strive to increase the interval between them in order to return to their initial or released state as shown in FIG. 3A. Once sleeve 11 is assembled upon arms 13, 14 of pin 12 to form a pressed state, sleeve 11 is maintained substantially fitted upon pin 12 due to the tension and/or friction force that is generated between the inner surface 16 of sleeve 11 and the arms 13, 14 that are maintained bearing outwards against surface 16.

Sleeve 11, during normal use of a jewelry system including a clasp, is otherwise not exposed to any substantial forces acting to urge it away from its engagement with the arms; and hence is kept safely parked in this "locking" position of the clasp by the radially outward directed forces exerted upon it by the arms.

For releasing clasp 10, one may apply sufficient external force on sleeve 11, which exceeds the threshold of e.g. friction force exposed thereupon via the bearing interaction with the arms, in order to move or slide sleeve 11 along chain 17, thereby easily disengaging sleeve 11 from pin 12 possibly in a single-action release mechanism.

Figure 5B:
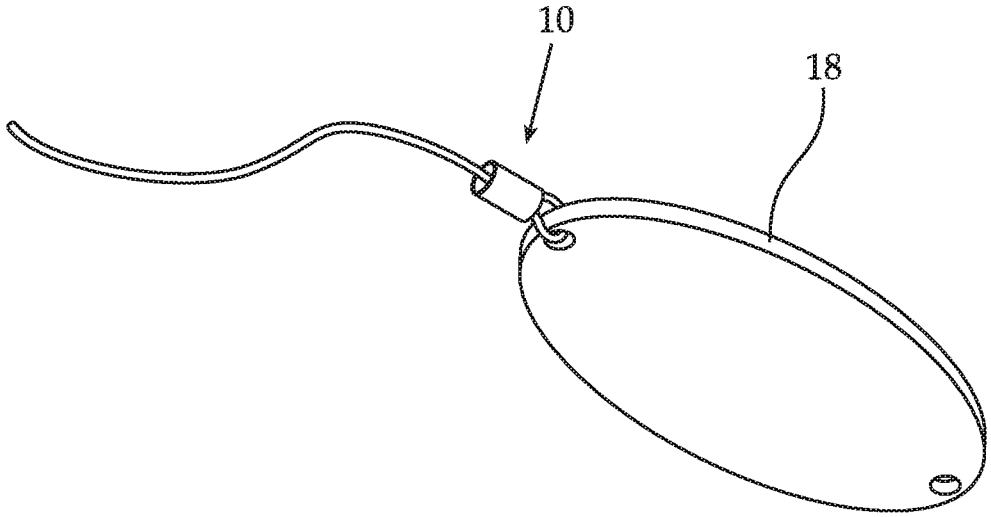
FIG. 5B schematically illustrates the clasp of FIG. 2 as part of a jewelry system in a closed state.
Figure 6:
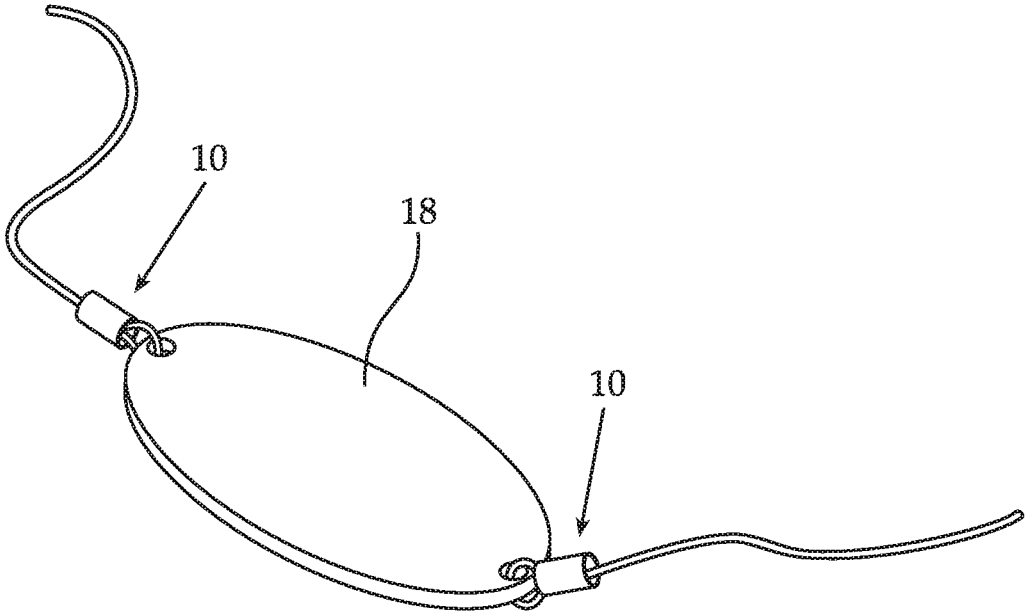
FIG. 6 schematically illustrates a jewelry systems including more than one clasp.

Once sleeve 11 is assembled on the pin's arms 13, 14, it can be used as a locking arrangement that closes and maintains e.g. the pendant 18 threaded in and/or upon pin 12, as schematically illustrated in FIG. 5B.

As will be appreciated by a person skilled in the art, sleeve 11 could be at any size, shape or design as long as it has the proper internal diameter to embrace the pin's arms together.

It should be noted that clasp 10 serves as a quick-action and simple linking mechanism for enabling a jewelry to become interchangeable, while maintaining a minimal size of the clasp, thereby maintaining the esthetics and the original design of the jewelry without any visual interference to the design lines.

It should also be noted that the interchangeable jewelry linking system of at least certain embodiments of the present invention, may not necessarily only used as a regular jewelry clasp, but also easily may be used to create new pieces of jewelry or jewelry combinations. Therefore the interchangeable jewelry linking system provides endless design possibilities.

For example, a pendant on a chain can easily be replaced with a different one, and be re-used on a bracelet/anklet/ ring/earring and so on. In another example, a necklace can be easily connected to another necklace to create a long chain, with or without ornaments. In yet another example, a necklace can be connected to a bracelet to create a longer chain or a long wrap around the bracelet. In still another example, an earring part can be connected to a chain to create a "T" chain, in which the earring part serves as an ornament.

Attention is now drawn to FIGS. 10A to 10F illustrating examples of how embodiments of clasp 10 may be utilized for forming a variety of interchangeable jewelry linking systems easily creating new pieces of jewelry.

Figure 10A:
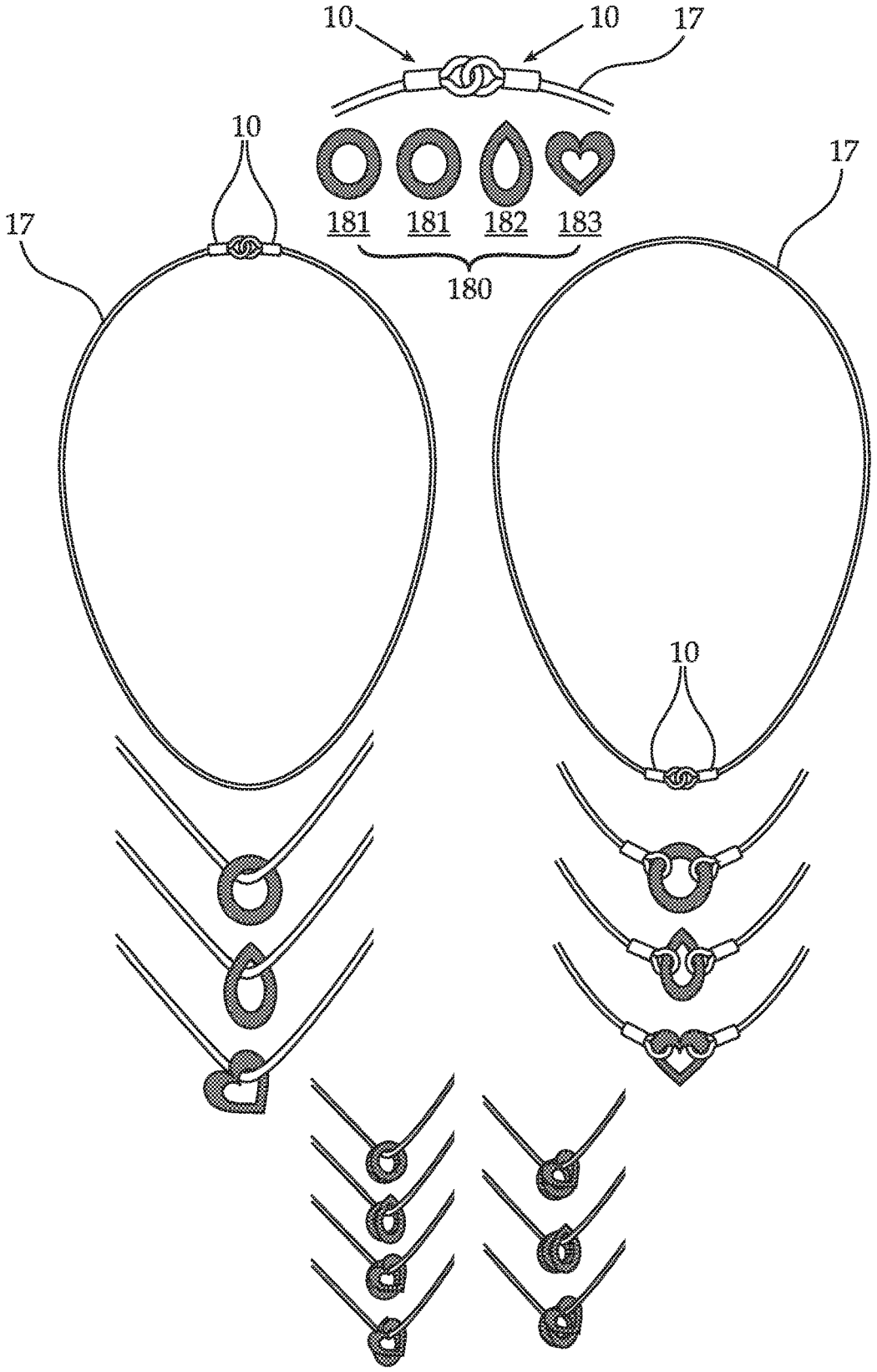
FIGS. 10A to 10F schematically illustrate further examples of jewelry systems including more than one clasp according to at least certain embodiments of the present invention.

In FIG. 10A, an example of how four possible pendants 180 and a chain 17 including at both ends an embodiment of a clasp 10 of the present invention may be utilized for forming a variety of possible jewelry combinations. The four pendants 180 in this example include a pair of earrings 181, a drop-like necklace pendant 182 and a heart shaped bracelet pendant 183.

The pendants 180 and chain 17 with clasps 10 may e.g. be in possession of a person, and in the following possible examples will be provided illustrating how interchangeability facilitated by the clasps 10 may be utilized for forming a variety of jewelry combinations.

Chain 17 in this example may be suitable for wearing as a necklace and may be oriented when worn on a neck (neck not shown) with the clasps 10 being either at an upper orientation of the necklace i.e. behind the neck at an anterior side of the neck (see upper left hand side of figure) or at a lower orientation of the necklace (see upper right hand side of figure).

As illustrated, the pendants 180 may be either threaded over chain 17 (as seen in the left side of the figure) or may be coupled to the clasps (i.e. fitted in-between the two clasps) to form a so called split-like necklace. In addition, several pendants may be chosen to be threaded over the chain (as illustrated at the lower middle side of the figure).

Figure 10B:
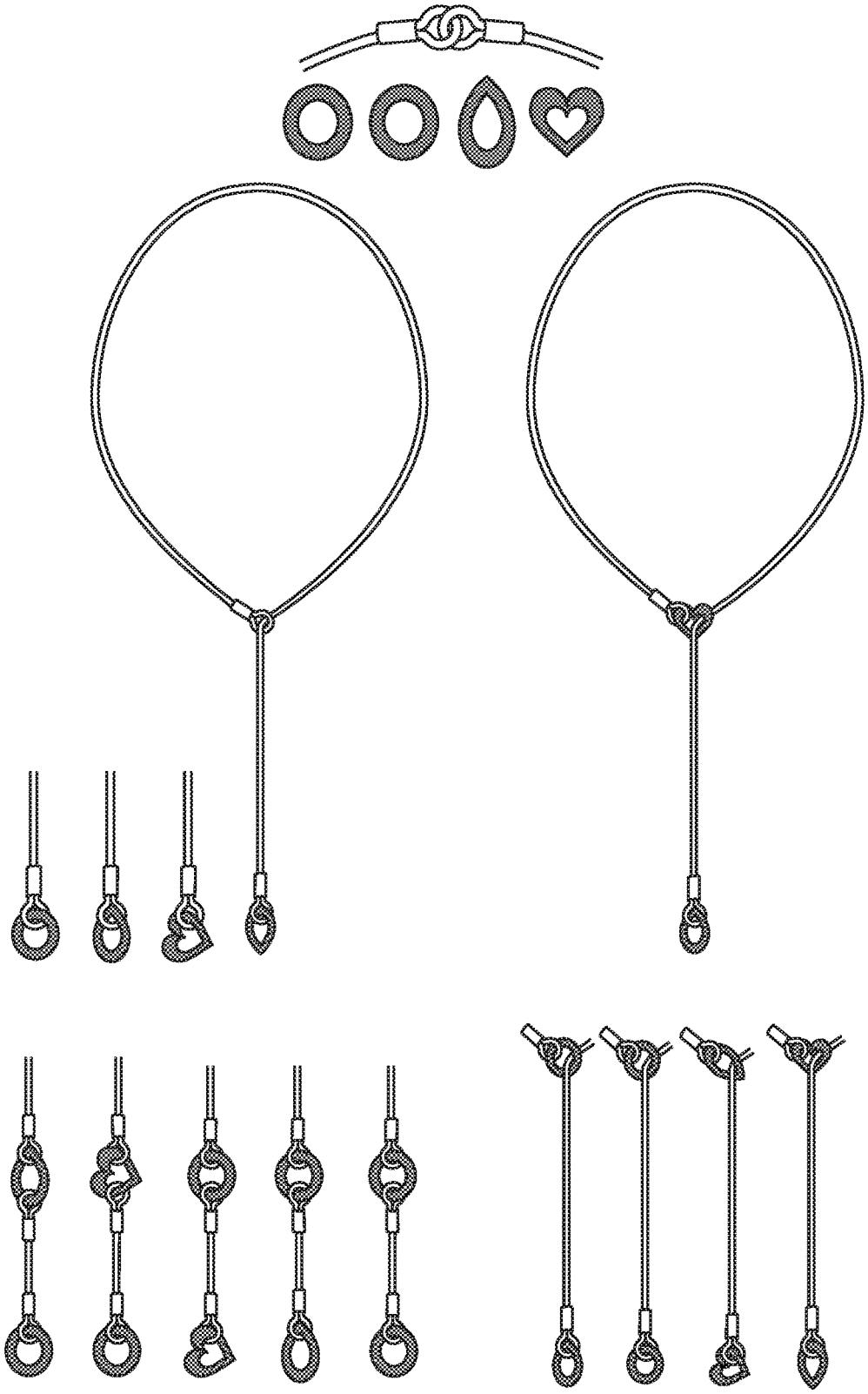

FIG. 10B illustrates a similar type modularity of how several pendants and a chain with two clasps at both ends may be utilized for forming various new pieces of jewelry. Here, the chain (see upper left hand side of figure) may be arranged as a tie-like necklace by closing one of the clasps (here the upper clasp) over the chain and then possibly utilizing the lower clasp (located at the end of the chain segment hanging down from the upper clasp) for fixing one or more pendants to the necklace.

In the upper right-hand side of the figure, the chain may be possibly arranged in a non-symmetric fashion with any chosen pendant being coupled to the clasps (i.e. fitted in-between the two clasps). At the lower side of this figure, an example is provided illustrating a shorter chain (possibly part of a split bracelet) being fitted at the bottom of the necklace as an aesthetic extension. In this example, the tie-like appearance may be provided by the chain being configured to pass through an opening in a pendant that is linked to a clasp fitted to the other end of the chain.

Figure 10C:
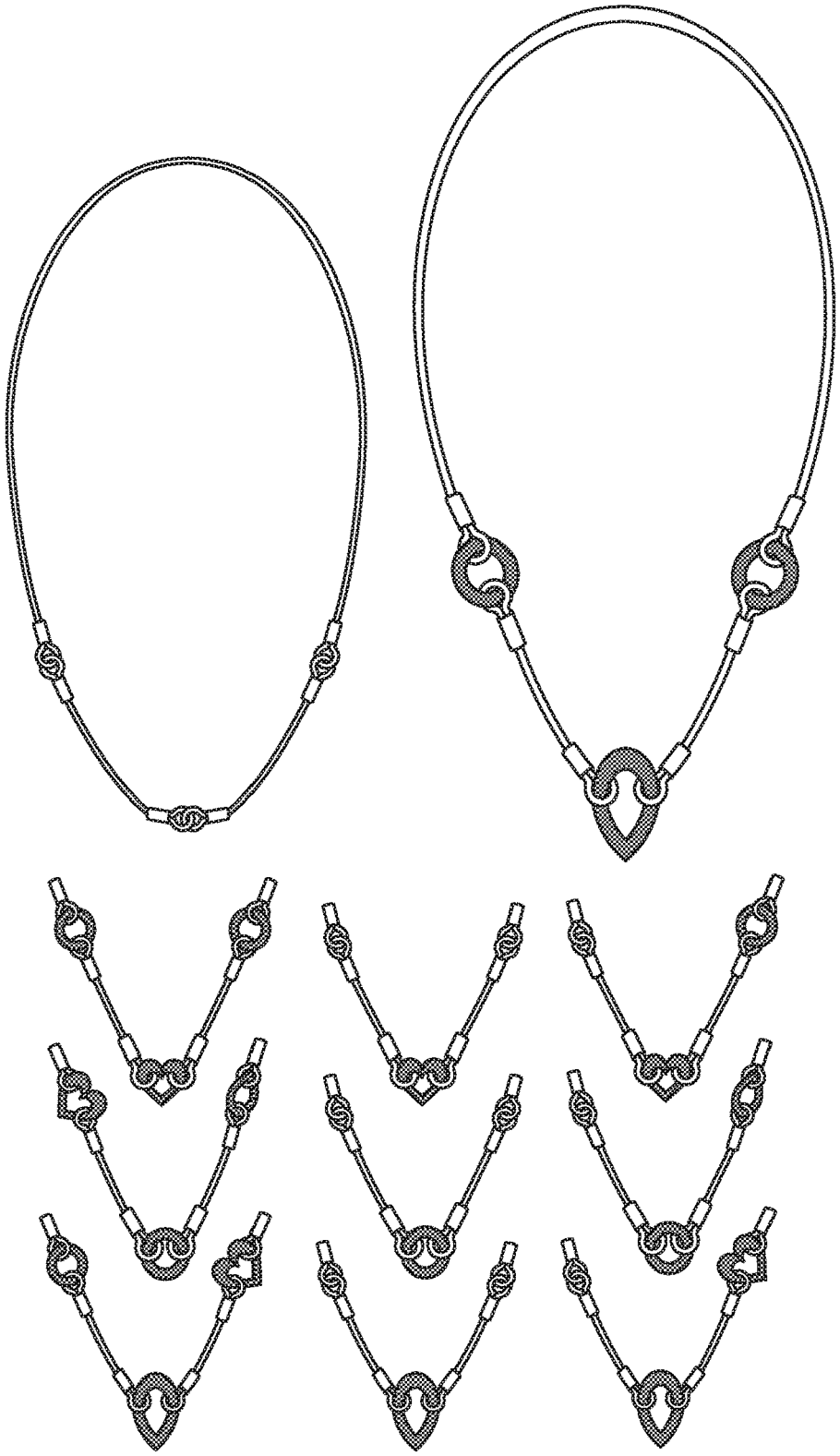
Figure 10D:
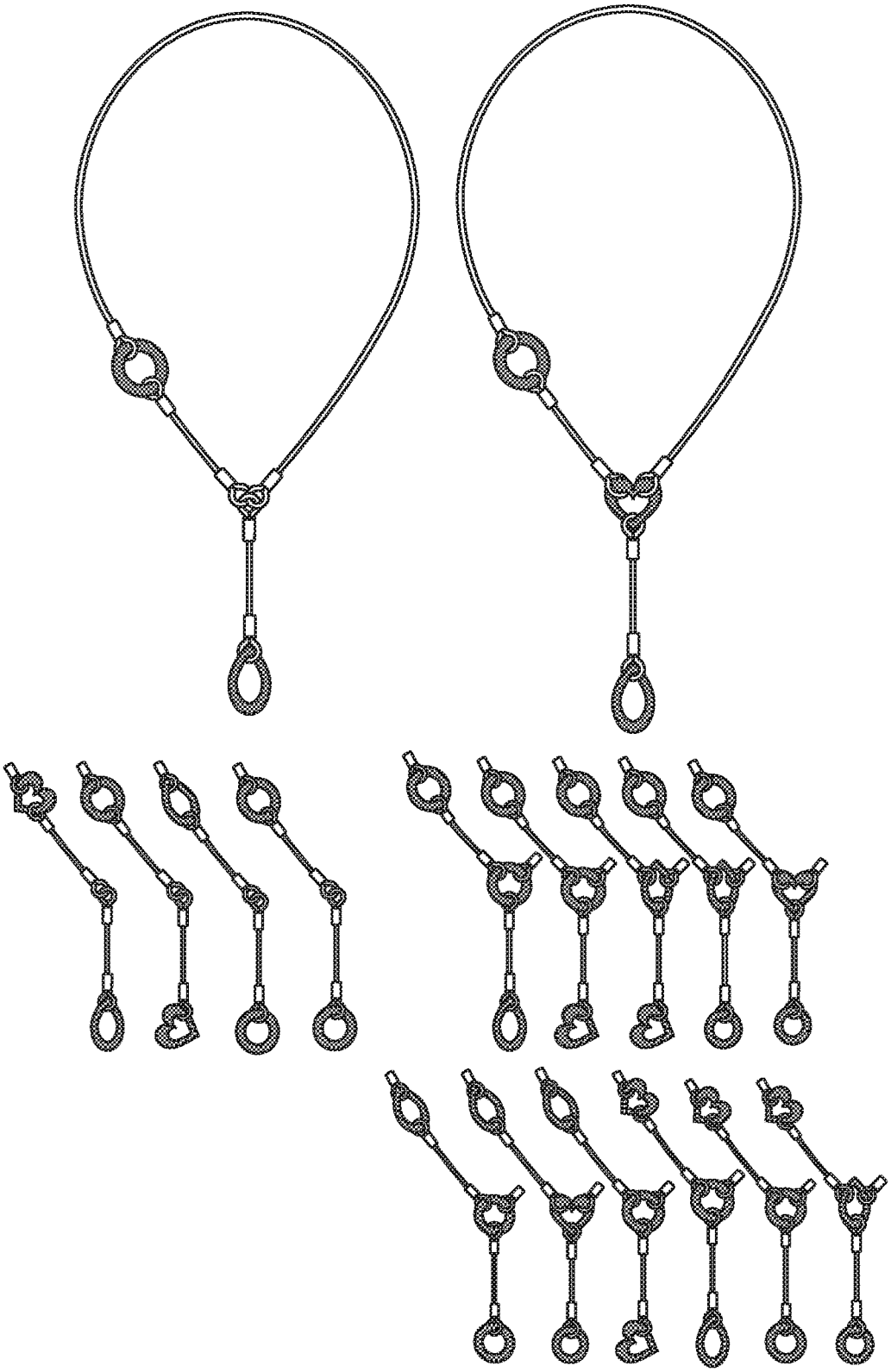
Figure 10E:
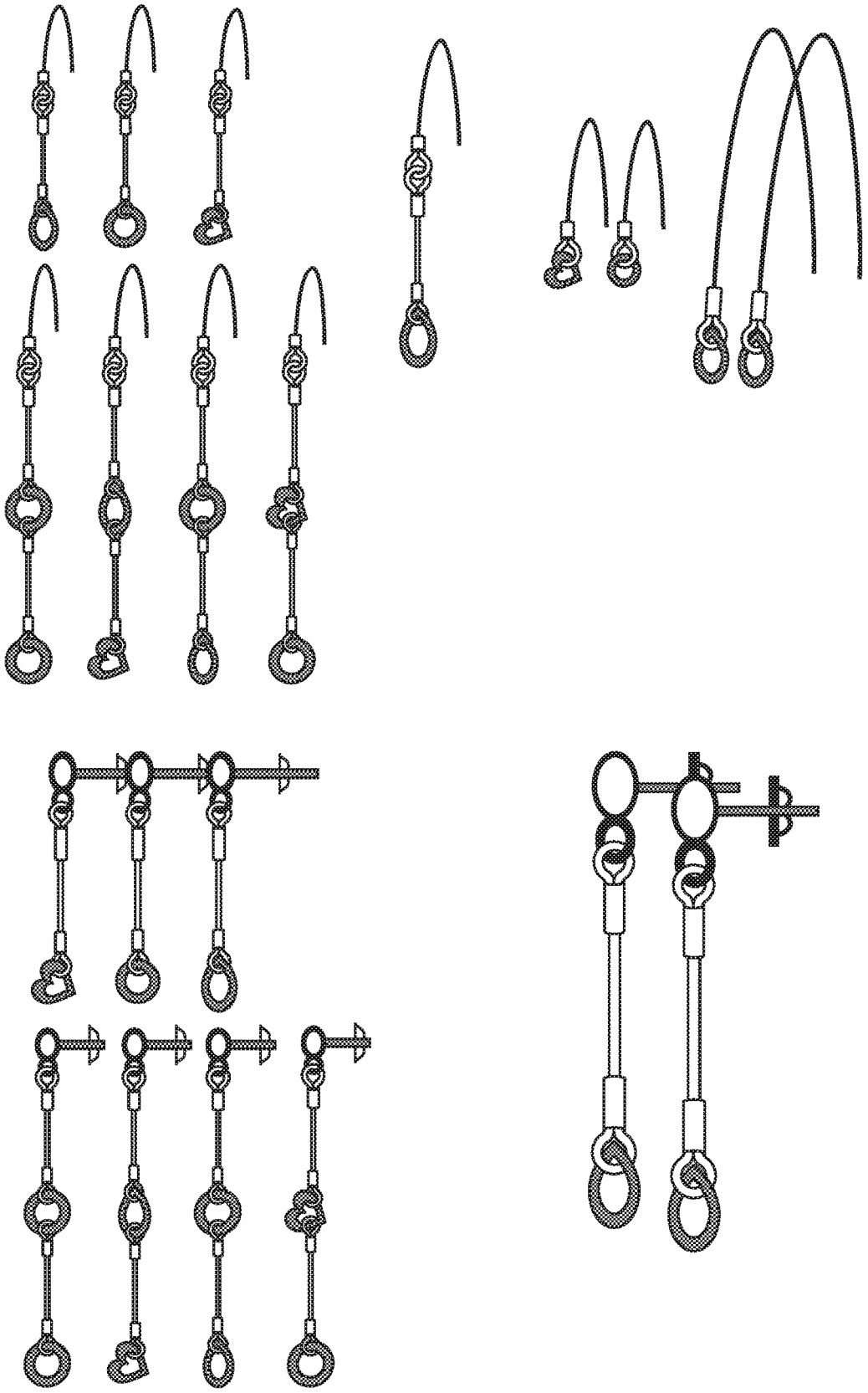
Figure 10F:
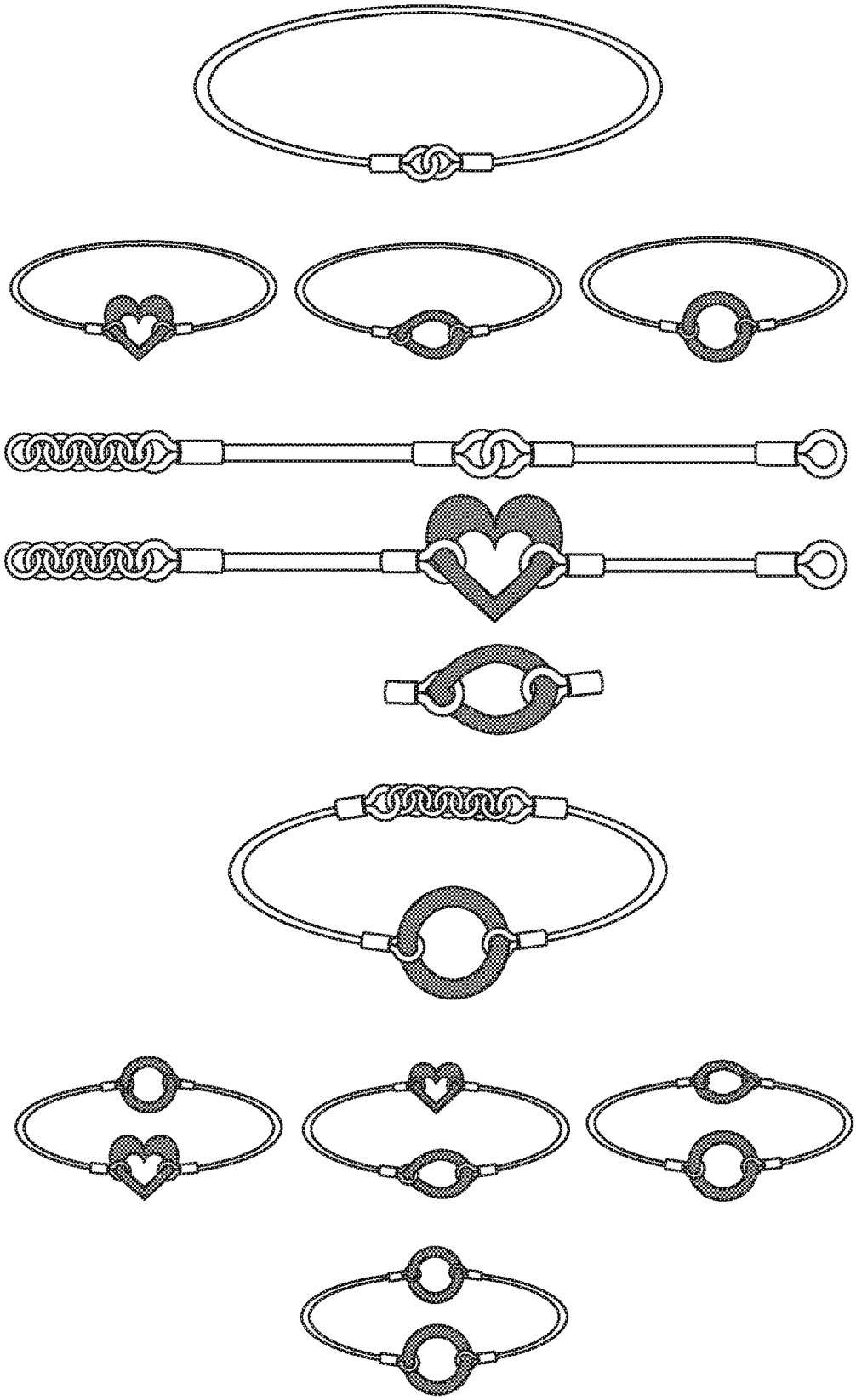

FIGS. 10C and 10D illustrate yet further examples of how two parts of a split bracelet may be fitted to a chain of a necklace with pendants being located in-between (and fitted) to two opposing clasps. And FIGS. 10E and 10F illustrate how earrings (FIG. 10E) may be used with chains of split-like bracelets together with pendants to form various jewelry combinations and/or how a chain with ring-like extension chains and a bracelet chain (FIG. 10F) may be used to form various jewelry combinations.

Hence, the above examples illustrate how clasp embodiments of the present invention, may be utilized for providing modularity in formation of new jewelry pieces or systems from jewelry already available to a client.

Figure 7A:
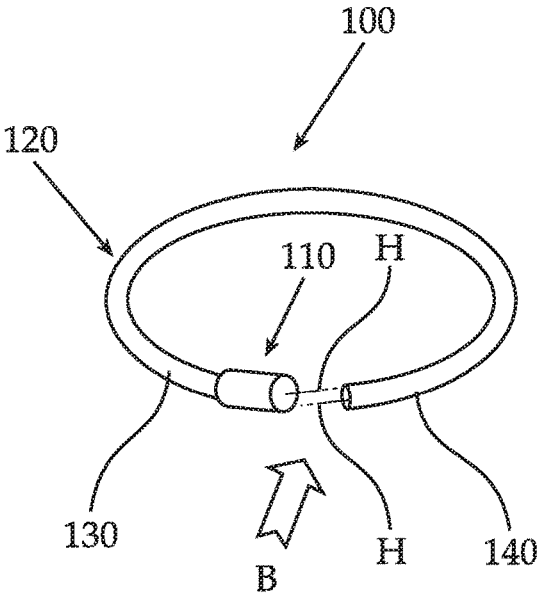
FIGS. 7A to 7D schematically illustrate an embodiment of a clasp, according to an aspect of the present invention.
Figure 7B:
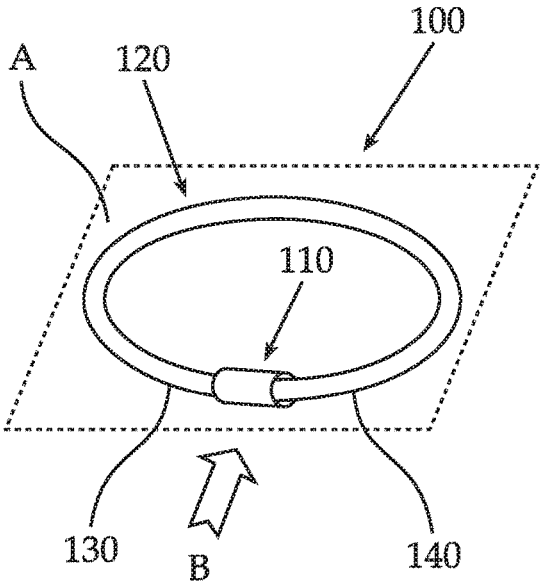

Referring now to FIGS. 7A to 7D, according to an aspect of the present invention, an embodiment of a clasp 100 may be configured to include a pin 120 having an open ring-like form. Pin 120 in this embodiment has two arms 130, 140 ending each at a respective end 131, 141; and a sleeve 110 slidably located upon one of the arms of pin 120, here arm 130. By sliding sleeve 110 towards the other arm 140 (or end 141) of pin 120, clasp 100 can be locked as shown in FIG. 7B, and by sliding sleeve 110 in the opposite direction clasp 100 can be unlocked as shown in FIG. 7A.

Plane 'A' marked in FIG. 7B represents a plane in which pin 120 with its arms 130, 140 may generally lie, when sleeve 110 is fitted over the ends 131, 141 of the arms. Direction 'B' marked in FIGS. 7A and 7B represents a view of the sleeve of clasp 100 that is taken along a direction generally located within plane 'A'.

Figure 7C:
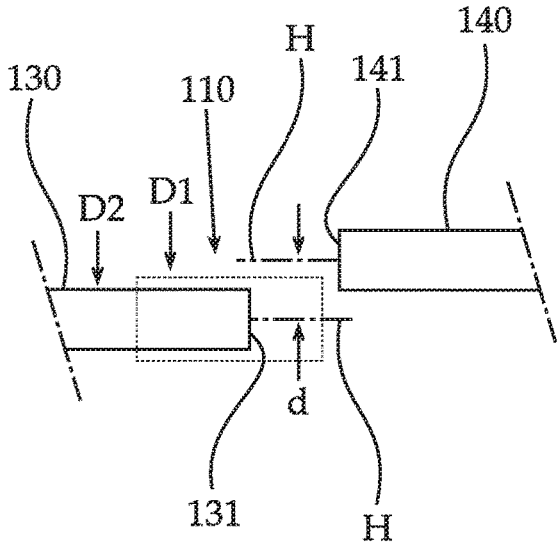
Figure 7D:
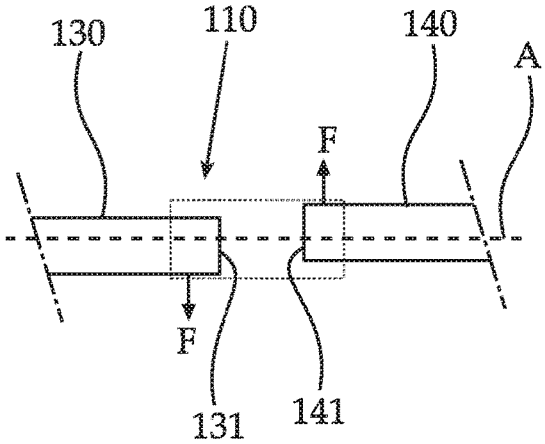

Consequently, a view taken along direction 'B' illustrates a view aimed at sleeve 110 and portions of the arms adjacent their respective ends 131, 141. FIG. 7C illustrates such a view as seen in FIG. 7A when clasp 100 is in an un-locked state; and FIG. 7D illustrates such a view as seen in FIG. 7B when clasp 100 is in a locked state.

As seen in FIG. 7C, the arms 130, 140 of clasp 100 in its un-locked state are configured to be un-aligned one in relation to the other adjacent their ends 131, 141; possibly due to pin 120 being configured to extend along a generally helical route H, possibly imparting to pin 120 a spring-like nature urging the un-alignment of the arm ends.

As seen, the shape of pin 120 is configured to position the un-alignment of its ends 131, 141 such that sleeve 110 in this position when located on one of the arms, even if urged to slide over the end of the arm is arranged to meet an opposing end (here end 141) of the other arm that stops it from falling off the arm (and hence stops it falling off from the pin 120).

In at least certain embodiments, the configuration of un-alignment of the ends 131, 141 (as marked in FIGS. 7A and 7C) may be defined by a distance 'd' between segments of helical route H adjacent ends 131, 141 and a width (possibly diameter) D2 of the arms and/or a width (possibly diameter) D1 of the sleeve; being configured to satisfy a relation of 'd' being generally smaller than about D1 and/or about D2.

In order to urge clasp 100 to the locked state seen in FIGS. 7B and 7D, the ends of the arms are (preferably manually) urged (at least momentarily) to be generally aligned one opposite the other, so that sleeve 110 can then be urged to slide in order cover both ends 131, 141 of the arms. In this position, when the arms are left alone, they are configured to flex back towards the un-aligned state (best seen in FIG. 7C) until meeting an internal surface of the sleeve 110 (as illustrated in FIG. 7D).

In this position, the biasing reaction of each arm against the internal surface of the sleeve, exerts a force F aimed at maintaining the sleeve in this position. Sliding sleeve 110 back towards the position seen in FIG. 7C will allow the arms to fully flex back to the position seen in FIG. 7C where clasp is in the un-locked state.

All the above description and examples have been given for the purpose of illustration and are not intended to limit the invention in any way. Many different mechanisms can be employed, all without exceeding the scope of the invention.

The invention claimed is:

1. A jewelry system comprising:

a clasp, the clasp having a common partial ring segment, two arms that extend towards their respective ends from the ring segment, and a sleeve, the sleeve being slidable to a position covering at least portions of both arms in order to urge the clasp from an un-locked state towards a locked state, which is maintained locked by at least portions of both arms bearing against an inner surface of the sleeve; and a flexible chain;

wherein each arm has an end, and the ends of the arms are more distant from each other in the un-locked state than in the locked state, and wherein, when both arms are pressed towards each other, they extend generally one alongside the other;

wherein one of the arms at its end is attached to the chain of the jewelry system, the attached arm and the chain being collinear where the attached arm and the chain are attached;

wherein the attachment is made permanent by welding; and wherein the sleeve is slidable over a full extension of the chain and is sized to cover and conceal the arms in the locked state of the clasp, and the common partial ring segment is sized to not permit its entrance into the sleeve.

2. The jewelry system of claim 1, wherein the sleeve at least in the un-locked state of the clasp is slidable over the chain.

3. The jewelry system of claim 1, wherein one arm is shorter than the other arm so that when pressed towards each other one of the arms projects beyond the end of the other arm.

4. The jewelry system of claim 1, wherein the common partial ring segment exhibits elasticity that assists in flexing the arms away from each other.

5. The jewelry system of claim 4, wherein the partial ring segment is configured to hold one or more of the following jewelry components: ornaments, charms, pendants, and chains.

* * * * *